US006569062B2

(12) United States Patent
Wang et al.

(10) Patent No.: US 6,569,062 B2
(45) Date of Patent: May 27, 2003

(54) LEVER TYPE, LOW LOADING EXERCISE APPARATUS

(76) Inventors: Leao Wang, No. 1, Lane 233, Sec. 2, Charng Long Rd., Taiping 411 (TW); Peter Wu, No. 1, Lane 233, Sec. 2, Charng Long Rd., Taiping 411 (TW)

( * ) Notice: Subject to any disclaimer, the term of this patent is extended or adjusted under 35 U.S.C. 154(b) by 0 days.

(21) Appl. No.: 09/841,120

(22) Filed: Apr. 25, 2001

(65) Prior Publication Data

US 2002/0160886 A1 Oct. 31, 2002

(51) Int. Cl.[7] ..... A63B 23/06
(52) U.S. Cl. ..... 482/54
(58) Field of Search ..... 482/51, 54, 148, 482/121, 140

(56) References Cited

U.S. PATENT DOCUMENTS 3,826,491 A * 7/1974 Elder ..... 482/7
4,974,831 A * 12/1990 Dunham ..... 482/54
5,072,928 A * 12/1991 Stearns et al. ..... 482/54
5,081,991 A * 1/1992 Chance ..... 482/54
5,184,988 A * 2/1993 Dunham ..... 482/54
5,626,539 A * 5/1997 Piaget et al. ..... 482/52
5,827,155 A * 10/1998 Jensen et al. ..... 482/54

* cited by examiner

*Primary Examiner*—Stephen R. Crow
(74) *Attorney, Agent, or Firm*—Troxell Law Office PLLC; Kuo-Hsiung Chiu

(57) ABSTRACT

The present invention relates to a lever type exercise apparatus comprises a base and a treadmill. The treadmill includes a platform and a continuous belt. The continuous belt extends around the platform and is rotatably supported by front and rear rollers being driven by a motor. Besides, a supporting arm is provided between the front and rear rollers of the treadmill. The bottom end thereof is pivotably connected at a first pivoting point of the base while the top end thereof is pivotably supported by a resilient cylinder which is pivotably secured to the base at a second pivoting point. After the assembly of the aforementioned components, when the front end of the treadmill is moved downward against the resistance of the resilient cylinder, the coupled supporting arm is pivoted at the first pivoting point. Thus, the top end of the supporting arm is pressed against the resilient cylinder. After the weight moves to the rear end of the treadmill, the treadmill restores itself to its original position by means of the upward resilience of the resilient cylinder. Accordingly, the treadmill moves up and down on a horizontal axis.

1 Claim, 4 Drawing Sheets

LEVER TYPE, LOW LOADING EXERCISE APPARATUS

RELATED APPLICATIONS

This application is related to U.S. Ser. No. 09/804,795 filed on Mar. 14, 2001 and currently pending.

BACKGROUND OF THE INVENTION

1. Field of the Invention

The present invention relates to an lever type exercise apparatus, and more particularly, to a low loading exercise treadmill in which the inclined angle of the treadmill can be changed in stepping down, thereby creating special movement travel for tremendously reducing the exercise loading of the walker.

2. Description of the Prior Art

The platform of the conventional treadmills is constantly kept at a fixed angle during the workout session. Consequently, when the user walks on the treadmill, it can reach the effect that he walks on the flat ground or on the slope. This exercise won't be overloaded for the common people. However, this kind of loading will be too much for people with worse physical conditions (like obesity, chronically cardiopulmonary disease, etc.), especially with long exercise session. Thus, an appropriate exercise amount can't be reached, thereby losing the expected exercise effect.

Meanwhile, an exercise treadmill, as shown in FIG. 4, is disclosed in the U.S. Pat. No. 5,626,539. This kind of treadmill apparatus 10 includes treadmills 12, 14 each of which is fitted with a continuous tread 16 which extends around a platform and is rotatably supported by rollers. Besides, a sliding movement effect is created during the walking session. However, the conventional treadmill apparatus 10 has a recess between two dual spring-loaded treads which is dangerous if the feet of the user fall into this recess. Moreover, it is necessary to raise the legs first and to press on the treadmill 12 or 14 at the higher position in walking on this exercise apparatus. Thereafter, the whole body weight (the raised gravity) is placed on the treadmill 12 or 14 so that the other treadmill 14 or 12 shifts upwardly. During the repeated exercise session, the foot of the user is placed on the treadmill 14 or 12 when either of them shifts upwardly. Accordingly, the weight of the foot has to be loaded on the user, but doesn't share the loading when the user raised his foot. So, the user can't exercise for a certain duration.

SUMMARY OF THE INVENTION

It is a primary object of the present invention to remove the above-mentioned drawbacks and to provide a low-loaded exercise treadmill through that the loading can be reduced in raising his body weight so that the user with special physical condition can easily and healthily perform the walking movement for a long session.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
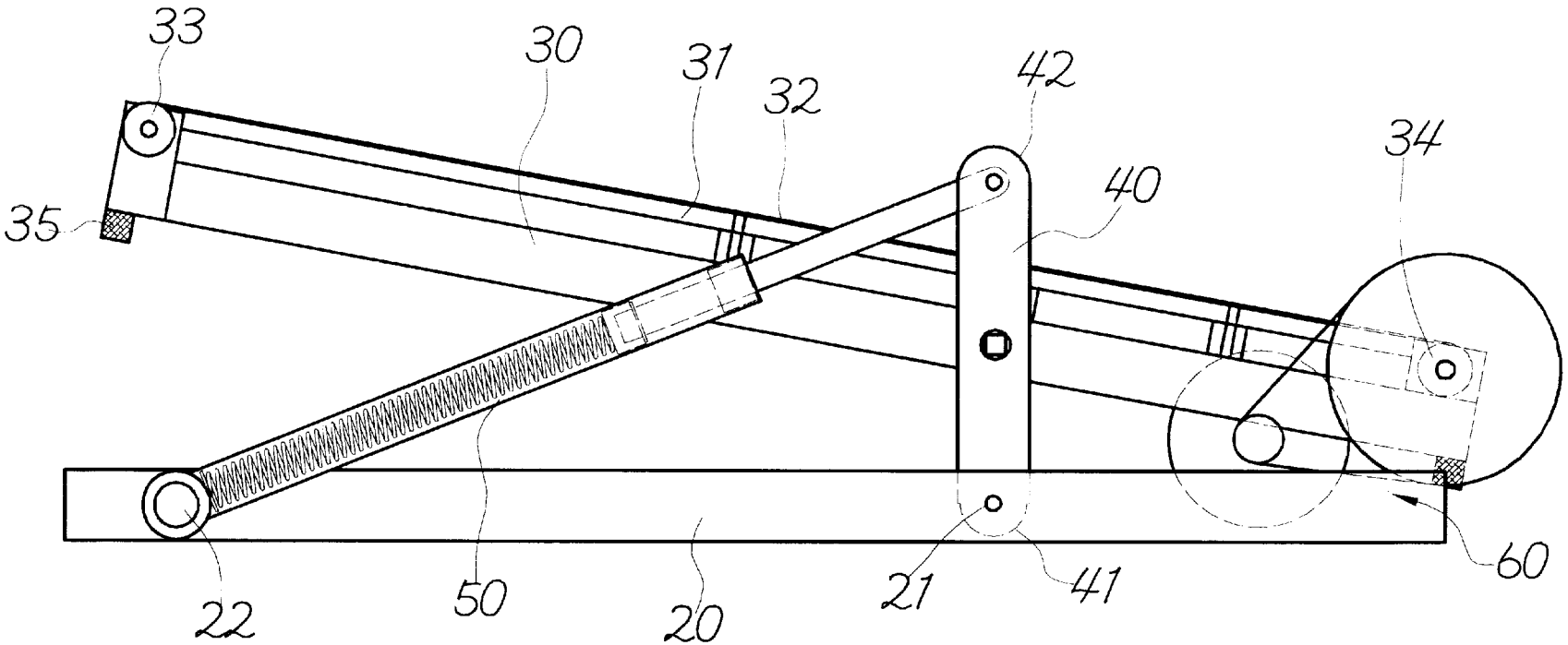
FIG. 1 is a side view of the present invention.
Figure 2:
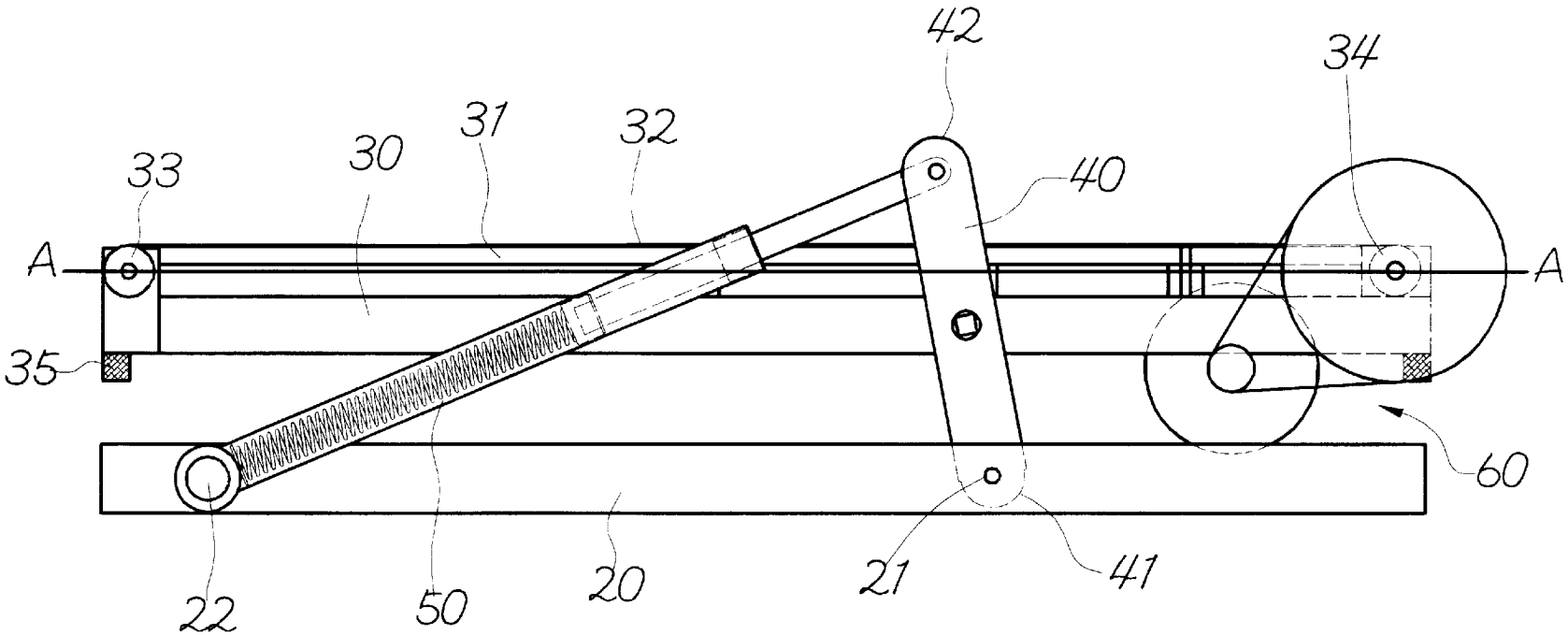
FIG. 2 is another side view of the present invention showing the action thereof.
Figure 3:
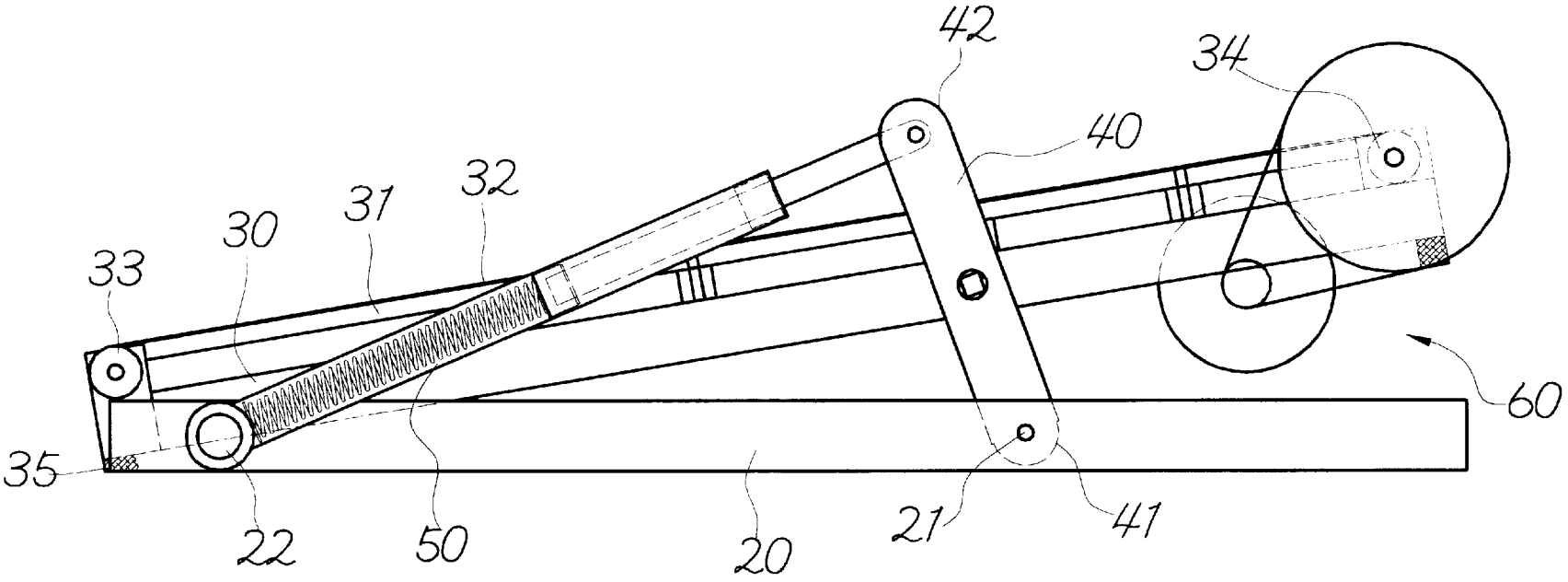
FIG. 3 is a further side view of the present invention showing the action thereof.
Figure 4:
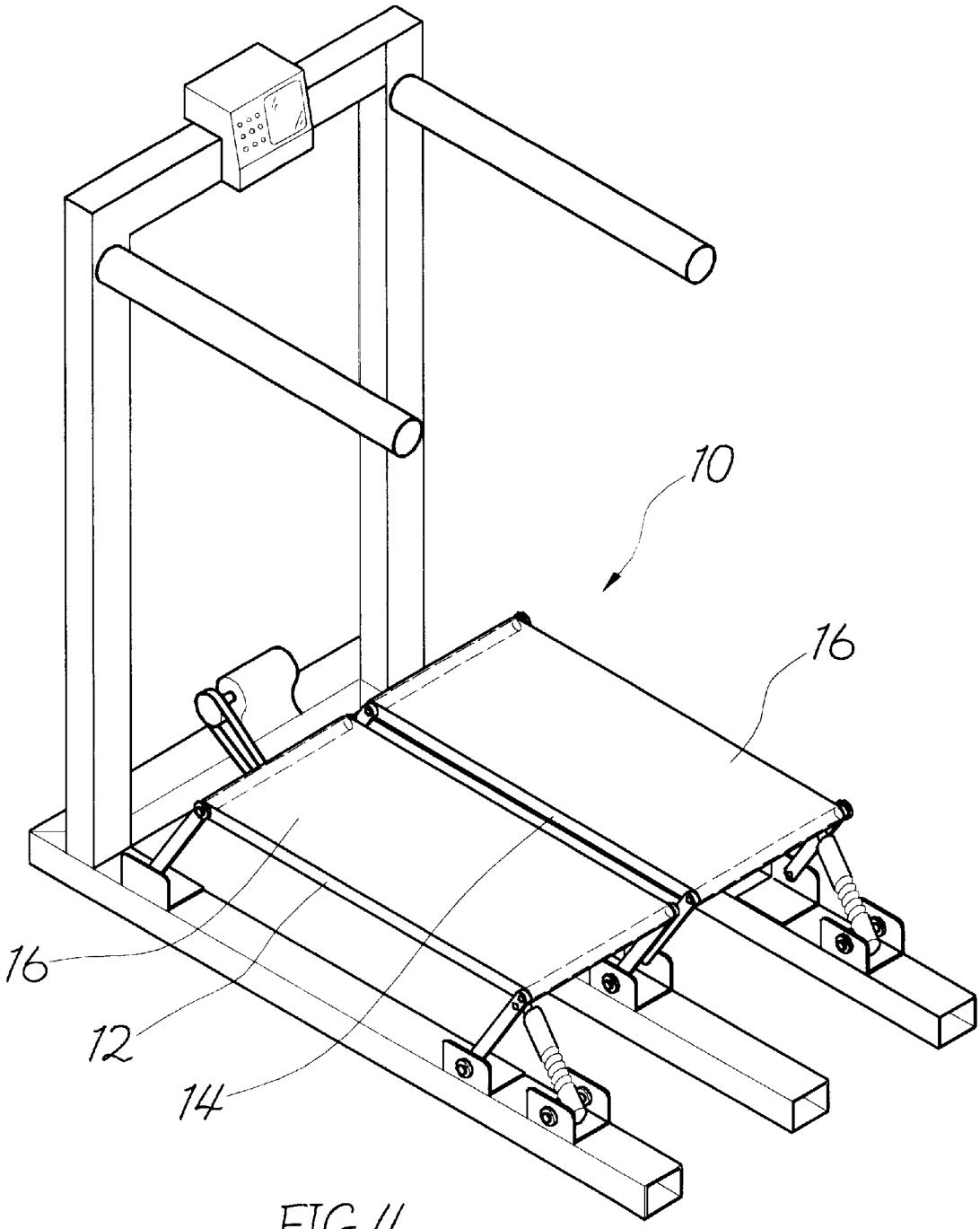
FIG.4 PRIOR ART
FIG. 4 is a perspective view of a known device.

First of all, referring to FIGS. 1–3, the low-loaded exercise treadmill in accordance with the present invention primarily is composed of a base 20 and a treadmill 30. The treadmill 30 includes a platform 31 and a continuous belt 32. The continuous belt 32 extends around the platform 31 and is rotatably supported by front and rear rollers 33, 34 being driven by a motor 60.

A supporting arm 40 is provided between the front and rear rollers 33, 34 of the treadmill 30. The bottom end 41 thereof is pivotably connected at a first pivoting point 21 of the base 20 while the top end 42 thereof is pivotably supported by a resilient cylinder 50 which is pivotably secured to the base 20 at a second pivoting point 22. After the assembly of the aforementioned components, when the front end of the treadmill 30 is moved downward against the resistance of the resilient cylinder 50, the coupled supporting arm 40 is pivoted at the first pivoting point 21. Thus, the top end 42 of the supporting arm 40 is pressed against the resilient cylinder 50. After the weight moves to the rear end of the treadmill 30, the treadmill 30 restores itself to its original position by means of the upward resilience of the resilient cylinder 50. Accordingly, the treadmill 30 moves up and down on a horizontal axis.

In other words, when the user places his both feet on the rear end of the continuous belt 32 and is ready for walking exercise, the treadmill 30 is kept at the original inclined position. After one foot of the user treads on the front end of the continuous belt 32, the treadmill 30 downwardly swivels on the first pivoting point 21 of the supporting arm 40 by means of the weight of the user and the treadmill 30 is downwardly inclined as illustrated in FIGS. 2 and 3. Thus, the treadmill 30 can support the weight of the user, thereby avoiding the loading when the user raises his own body weight while the expected exercise effect can also be reached.

A phantom horizontal axis A—A (see FIG. 2) based on the front and rear rollers 33, 34 extends parallel to the ground. The treadmill 30 makes regularly upward and downward movement on the horizontal axis. Accordingly, the loading of the body weight of the user can be imperceptibly eliminated during the downward process of the treadmill 30.

U.S. Pat. No. 4,974,831 discloses a shock absorber that can only reduce the reacting force so that the dampening travel of the treadmill is very slight. On the contrary, the treadmill of the present invention has a greater displacement travel, thereby fully eliminating the raising gravity produced during the walking session.

Furthermore, a cushion 35 is provided at each side of the bottom end of the treadmill 30. During the see-saw motion, the cushion 35 is used for absorbing the shock and for limiting the see-saw travel.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A low load treadmill exercise device comprising:

a) a base having opposite ends;

b) a treadmill platform having an endless belt movably mounted thereon, the treadmill platform having opposite ends;

c) a supporting arm having a first end portion pivotally connected to the base between the opposite ends of the base, a mid-portion pivotally connected to the treadmill platform between the opposite ends of the treadmill platform so as to pivot about an axis located above the base, and a second end; and, d) a resilient cylinder pivotally connected to the base and to the second end of the supporting arm.

* * * * *